US006674269B1

(12) United States Patent
McIntyre

(10) Patent No.: US 6,674,269 B1
(45) Date of Patent: Jan. 6, 2004

(54) LIGHT EMITTING DIODE DRIVER AND IMAGE FORMING DEVICE INCLUDING THE SAME

(75) Inventor: Harry Jonathan McIntyre, Los Angeles, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/252,895

(22) Filed: Sep. 23, 2002

(51) Int. Cl.[7] ..... G05F 1/40
(52) U.S. Cl. ..... 323/266
(58) Field of Search ..... 323/266, 268, 323/270, 273, 275, 276, 280; 327/509, 514

(56) References Cited

U.S. PATENT DOCUMENTS 5,570,421 A * 10/1996 Morishima ..... 379/396
6,226,539 B1 * 5/2001 Potratz ..... 600/323
6,265,832 B1 * 7/2001 Maisel et al. ..... 315/164
6,359,392 B1 * 3/2002 He ..... 315/291
6,486,726 B1 * 11/2002 Worley et al. ..... 327/514

* cited by examiner

*Primary Examiner*—Matthew V. Nguyen
(74) *Attorney, Agent, or Firm*—Wayne J. Egan

(57) ABSTRACT

A light emitting diode driver is arranged to supply a drive current to a light emitting diode. The light emitting diode forms a radiant output and is arranged with a photo detector that forms a monitor signal based on the radiant output. The drive current comprises a first current and a second current. A comparison signal is formed by comparing the monitor signal and a level control signal. A buffered output signal is provided based on the comparison signal. The first current is provided based on the buffered output signal. A difference voltage is formed based on the first current. An amplified signal is provided based on the difference voltage. The second current is provided based on the amplified signal.

34 Claims, 4 Drawing Sheets

LIGHT EMITTING DIODE DRIVER AND IMAGE FORMING DEVICE INCLUDING THE SAME

BACKGROUND OF THE INVENTION

A traditional light emitting diode driver is depicted in FIG. 3. As shown therein, the level control signal 30 determines the final level of the current 1 in the light emitting diode 21. If the signal feedback 4 from the photo diode 23 to the comparator 5 is less than the level control signal 30, the comparator 5 sends an increased signal 6 to the operational amplifier 12 which buffers the increasing signal to the current source 10, which increases the light emitting diode 21's radiant output 22 which finally increases the feedback signal 4 until it equals the level control signal 30.

SUMMARY OF THE INVENTION

In one aspect of the invention, there is described a light emitting diode driver arranged to supply a drive current to a light emitting diode, the light emitting diode arranged with a photo detector that forms a monitor signal based on a radiant output that is formed by the drive current and the light emitting diode, the drive current comprising a first current and a second current and formed by comparing the monitor signal and a level control signal to form a comparison signal; providing a buffered output signal based on the comparison signal; providing a voltage difference based on the buffered output signal and the drive current's nodal voltage; forming a first current based on the voltage difference and a resistor; providing an amplified signal based on the voltage difference; and providing the second current based on the amplified signal.

In another aspect of the invention, there is described a light emitting diode driver arranged to supply a drive current to a light emitting diode, the light emitting diode arranged with a photo detector that forms a monitor signal based on a radiant output that is formed by the drive current and the light emitting diode, the drive current comprising a first current and a second current; the first current formed by a voltage difference across a resistor; the voltage difference formed by drive current's nodal voltage and the high speed buffer output; a high-speed buffer output formed by a comparison signal; a comparison signal formed by comparing the monitor signal and a level control signal; and the second current provided by a current source whose input terminal is driven by an operational amplifier, the operational amplifier having an input signal that is the voltage difference formed by drive current's nodal voltage and the high speed buffer output.

In a further aspect of the invention, there is described an image forming device comprising a light emitting diode driver, the light emitting diode driver arranged to supply a drive current to a light emitting diode, the light emitting diode arranged with a photo detector that forms a monitor signal based on a radiant output that is formed by the light emitting diode, the drive current comprising a first current and a second current and formed by comparing the monitor signal and a level control signal to form a comparison signal; providing a buffered output signal based on the comparison signal; providing a voltage difference based on the buffered output signal and the drive current's nodal voltage; forming a first current based on the voltage difference and a resistor; providing an amplified signal based on the voltage difference; and providing the second current based on the amplified signal.

In yet another aspect of the invention, there is described an image forming device comprising a light emitting diode driver, the light emitting diode driver arranged to supply a drive current to a light emitting diode, the light emitting diode arranged with a photo detector that forms a monitor signal based on a radiant output that is formed by the light emitting diode, the drive current comprising a first current and a second current; the first current formed by a voltage difference across a resistor; the voltage difference formed by drive current's nodal voltage and the high speed buffer output; a high-speed buffer output formed by a comparison signal; a comparison signal formed by comparing the monitor signal and a level control signal; and the second current provided by a current source whose input terminal is driven by an operational amplifier, the operational amplifier having an input signal that is the voltage difference formed by drive current's nodal voltage and the high speed buffer output.

DETAILED DESCRIPTION OF THE INVENTION

Briefly, a light emitting diode driver is arranged to supply a drive current to a light emitting diode. The light emitting diode forms a radiant output and is arranged with a photo detector that forms a monitor signal based on the radiant output. The drive current comprises a first current and a second current. A comparison signal is formed by comparing the monitor signal and a level control signal. A buffered output signal is provided based on the comparison signal. A difference signal provided by the buffered output signal and the drive current's nodal voltage. The first current is provided based on the voltage difference and a resistor. An amplified signal is provided based on the voltage difference. The second current is provided based on the amplified signal.

Figure 1:
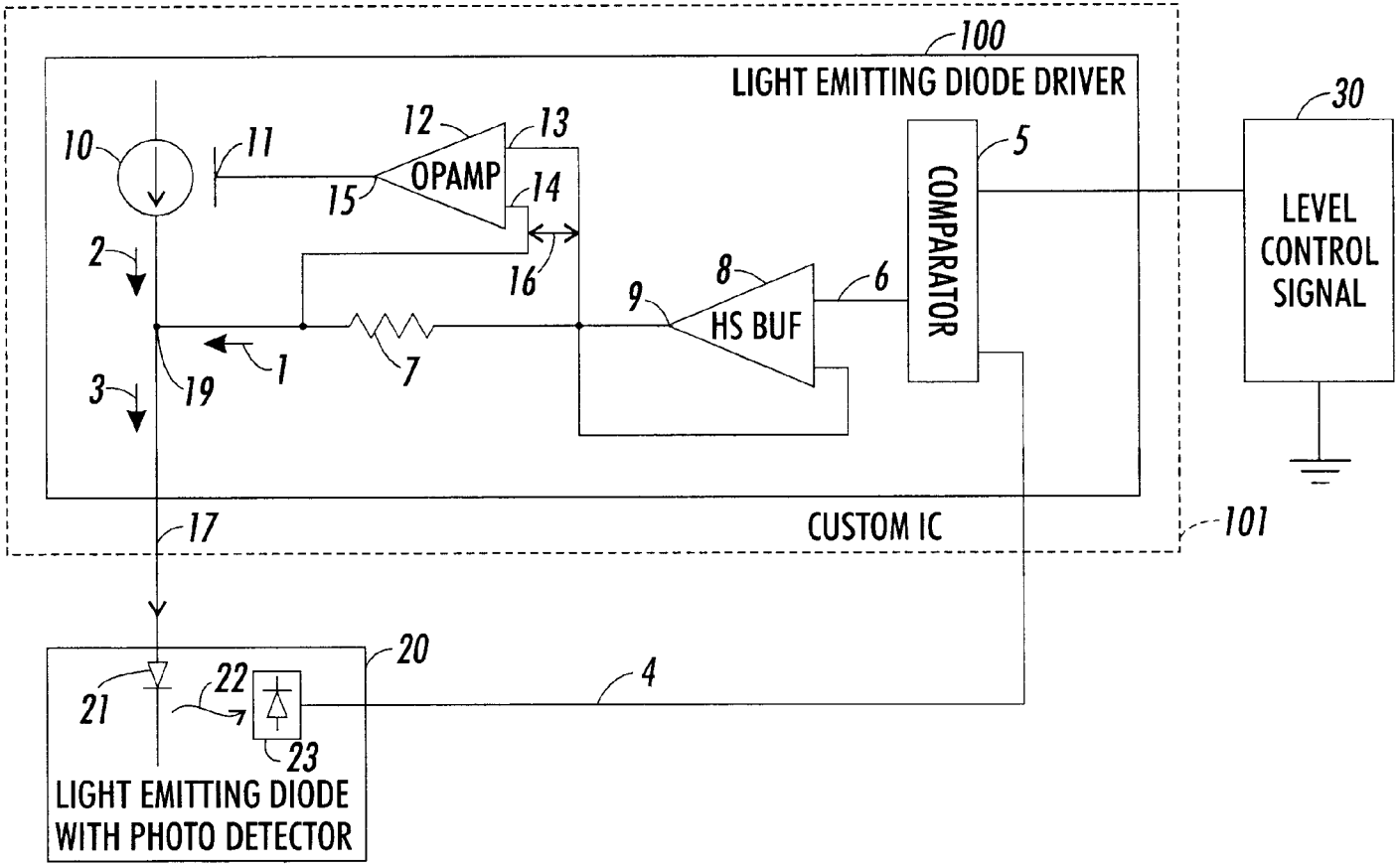
FIG. 1 is a circuit schematic drawing of a first embodiment 100 of a light emitting diode driver, in accordance with the present invention. As depicted, the light emitting diode driver 100 supplies a drive current 3 that forms a "current source" in a first flow direction 17 from the light emitting diode driver 100 to a light emitting diode 21. As depicted, in one embodiment, the light emitting diode driver 100 comprises a custom integrated circuit 101.
Figure 1A:
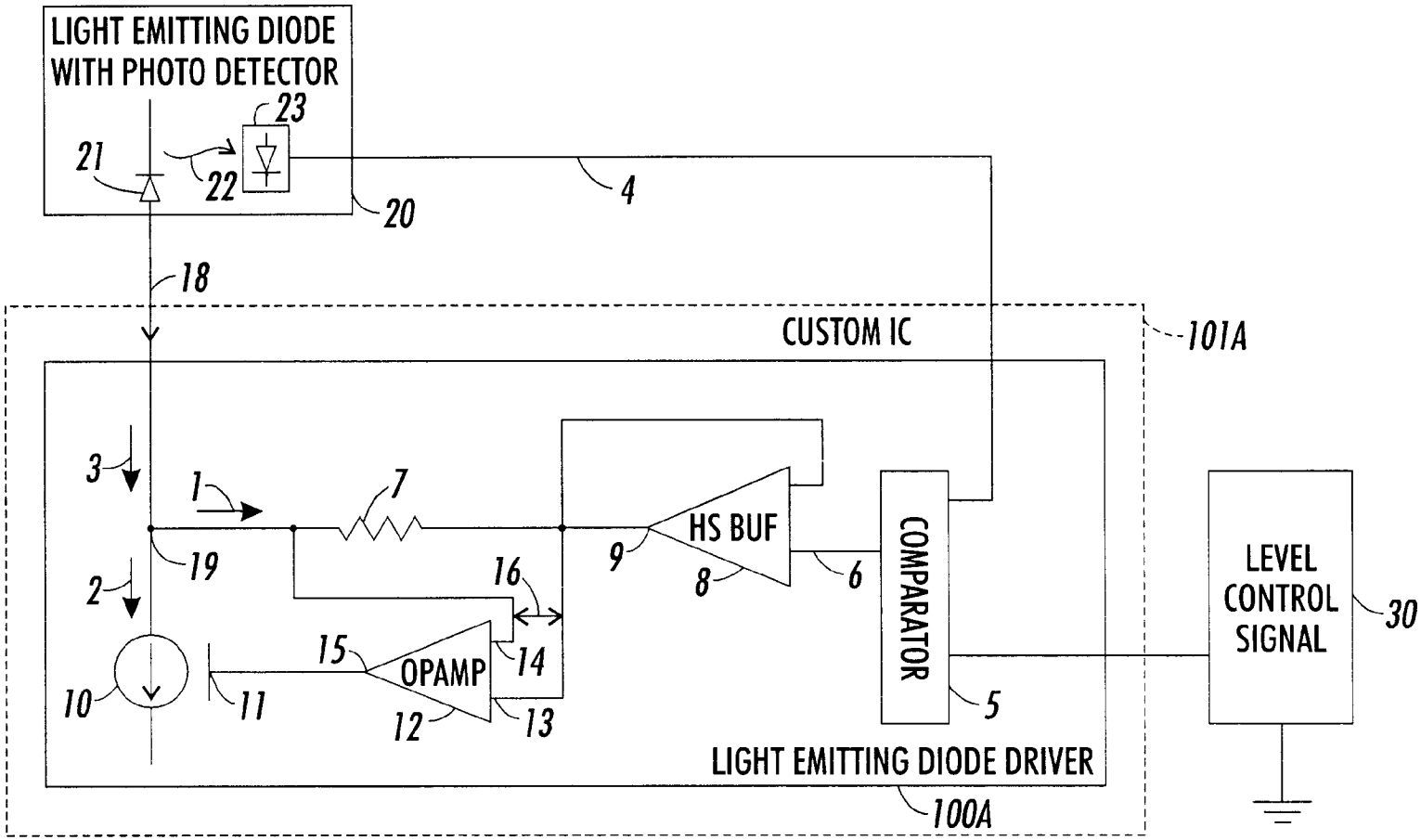
FIG. 1A is a circuit schematic drawing of a second embodiment 100A of a light emitting diode driver, in accordance with the present invention. As depicted, the light emitting diode driver 100A supplies a drive current 3 that forms a "current sink" in a second flow direction 18 from the light emitting diode 21 to the light emitting diode driver 100A. As depicted, in one embodiment, the light emitting diode driver 100A comprises a custom integrated circuit 101A.

Referring now to FIG. 1 and FIG. 1A, there are respectively depicted therein first 100 and second 100A embodiments of a light emitting diode driver, in accordance with the present invention. As described below, each light emitting diode driver 100 and 100A is arranged to supply a corresponding drive current 3 to a light emitting diode 21.

As depicted in FIG. 1, the first embodiment of a light emitting diode driver 100 is arranged to supply the drive current 3 that forms a "current source" of positive charge in a flow direction 17 from the light emitting diode driver 100 to the light emitting diode 21.

As depicted in FIG. 1A, the second embodiment of a light emitting diode driver 100A is arranged to supply the drive current 3 that forms a "current sink" of positive charge in a flow direction 18 from the light emitting diode 21 to the light emitting diode driver 100A.

Still referring now to FIGS. 1 and 1A, the light emitting diode driver (that is, each individual light emitting diode driver 100 and 100A) is arranged to supply a drive current 3 to a light emitting diode 21. The light emitting diode 21 forms a radiant output 22 that is based on the drive current 3. Also, the light emitting diode 21 is arranged with a photo detector 23. The photo detector 23, in turn, forms a monitor signal 4 that is based on the radiant output 22.

The drive current 3 comprises a first current 1 and a second current 2. The drive current 3 is formed by the interaction of various components comprised in the light emitting diode driver (100 and 100A), including a comparator 5, a high-speed buffer 8, a resistor 7, an operational amplifier 12 and a current source 10. This interaction is described below.

The comparator 5 compares the monitor signal 4 and a level control signal 30 to form a comparison signal 6. The high-speed buffer 8 provides a buffered output signal 9 based on the comparison signal 6. The buffered output signal 9 and the drive current's nodal voltage 19 provides a voltage difference 14. The voltage difference 14 and the resistor 7 provide the first current 1.

The voltage difference 16 is input to the operational amplifier 12. The operational amplifier 12 provides an amplified signal 15 based on the voltage difference 16. The amplified signal 15 drives the input terminal 11 of the current source 10. The current source 10 provides the second current 2 based on the amplified signal 15.

The value of the resistor 7 is chosen based on the voltage difference 16 such that a sufficient first current 1 provides sufficient radiant light 22 formed by the light emitting diode 21, thus providing a sufficient monitor signal, based on the radiant light 22, to become equal to the level control signal 30.

Still referring to FIGS. 1 and 1A, the operational amplifier 12 includes a first amplifier input 13 coupled to the buffered output signal 9 and a first terminal of the resistor 7 and a second amplifier input 14 coupled to the current source 10 and a second terminal of the resistor 7.

Referring still to FIG. 1 and FIG. 1A, there is depicted a light emitting diode driver depicted as reference number 100 in FIG. 1 and reference number 100A in FIG. 1A arranged to supply a drive current 3 to a light emitting diode 21. The light emitting diode 21 is arranged with a photo detector 23 that forms a monitor signal 4 based on a radiant output 22 that is formed by the light emitting diode 21. The drive current 3 comprises a first current 1 and a second current 2. The first current 1 is formed by a voltage difference across a resistor 7; the voltage difference formed by drive current's nodal voltage 19 and the high speed buffer output 9; a high-speed buffer output 9 formed by a comparison signal 6; a comparison signal formed by comparing the monitor signal 4 and a level control signal 30; and the second current provided by a current source whose input terminal is driven by an operational amplifier, the operational amplifier having an input signal that is the voltage difference formed by drive current's nodal voltage 19 and the high speed buffer output 9. As shown, the operational amplifier 12 includes a first amplifier input 13 coupled to the buffered output signal 9 and a first terminal of the resistor 7 and a second amplifier input 14 coupled to the current source 10 and a second terminal of the resistor 7.

Still referring to FIGS. 1 and 1A, in one embodiment, the first amplifier input 13 is the familiar positive ("+") input of the operational amplifier 12 and the second amplifier input 14 is the familiar negative ("−") input of the operational amplifier 12.

Referring now to FIG. 1, in one embodiment, the light emitting diode driver 100 comprises a custom integrated circuit 101, depicted in broken lines.

Referring now to FIG. 1A, in one embodiment, the light emitting diode driver 100A comprises a custom integrated circuit 101A, depicted in broken lines.

Figure 2:
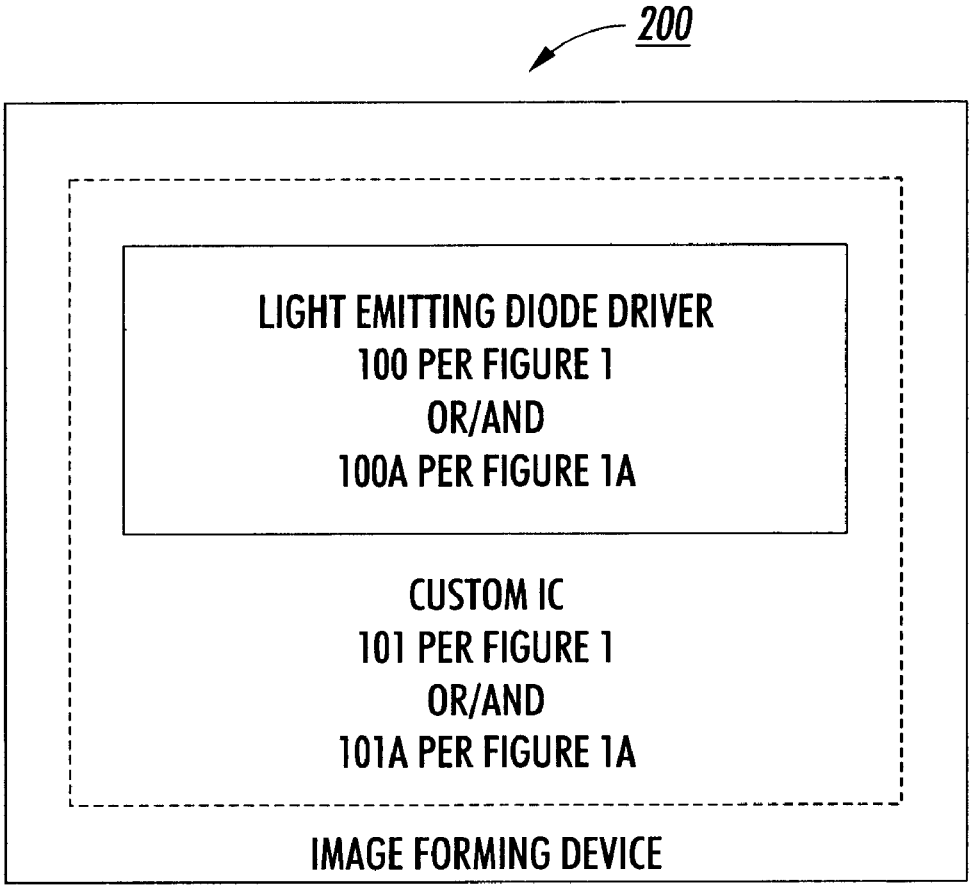
FIG. 2 is a block diagram of an image forming device 200 including at least one of the light emitting diode driver 100 that is depicted in FIG. 1, or at least one of the light emitting diode driver 100A that is depicted in FIG. 1A, or both. When the FIG. 1 light emitting diode driver 100 is provided, in one embodiment, the light emitting diode driver 100 comprises the custom integrated circuit 101 that is depicted in FIG. 1. When the FIG. 1A light emitting diode driver 100A is provided, in one embodiment, the light emitting diode driver 100A comprises the custom integrated circuit 101A that is depicted in FIG. 1A.
Figure 3:
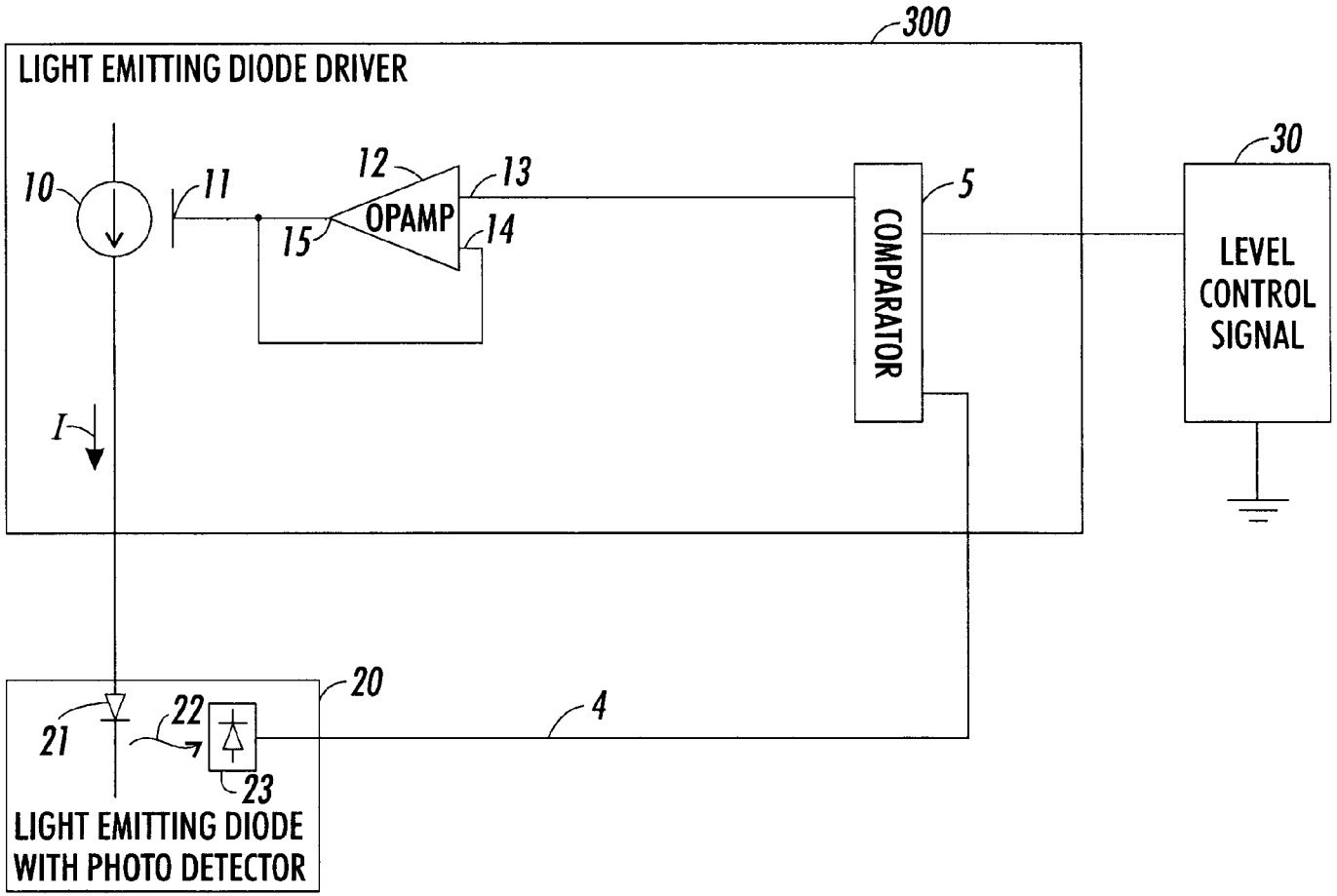
FIG. 3 PRIOR ART
FIG. 3 depicts a traditional light emitting diode driver arrangement.

Referring now to FIG. 2, there is depicted a block diagram of an image forming device 200 including at least one light emitting diode driver 100 as depicted in FIG. 1, at least one light emitting diode driver 100A as depicted in FIG. 1A, or both.

Still referring to FIG. 2, when the image forming device 200 includes the FIG. 1 light emitting diode driver 100, in one embodiment, the light emitting diode driver 100 comprises the FIG. 1 custom integrated circuit 101.

Still referring to FIG. 2, when the image forming device 200 includes the FIG. 1A light emitting diode driver 100A, in one embodiment, the light emitting diode driver 100A comprises the FIG. 1 custom integrated circuit 101A.

Still referring to FIG. 2, in one embodiment, the image forming device 200 comprises a printing machine. In another embodiment, the image forming device 200 comprises a photocopying machine. In still another embodiment, the image forming device 200 comprises a facsimile machine.

In summary, there has been described a light emitting diode driver corresponding to reference number 100 in FIG. 1 and to reference number 100A in FIG. 1A that is arranged to supply a drive current 3 to a light emitting diode 21, the light emitting diode 21 arranged with a photo detector 23 that forms a monitor signal 4 based on a radiant output 22 that is formed by the light emitting diode 21, the drive current 3 comprising a first current 1 and a second current 2 and formed by comparing the monitor signal 4 and a level control signal 30 to form a comparison signal 6; providing a buffered output signal 9 based on the comparison signal 6; providing a voltage difference 16 formed by the buffered output signal and the drive current's nodal voltage 19; providing the first current 1 based on the voltage difference 16 and the resistor 7; providing an amplified signal 15 based on the difference voltage 16; and providing the second current 2 based on the amplified signal 15. As described in connection with FIGS. 1 and 1A, the difference voltage 16 is formed by the buffered output signal and the driver current's nodal voltage 19.

In further summary, there has also been described a light emitting diode driver corresponding to reference number 100 in FIG. 1 and to reference number 100A in FIG. 1A that is arranged to supply a drive current 3 to a light emitting diode 21, the light emitting diode 21 arranged with a photo detector 23 that forms a monitor signal 4 based on a radiant output 22 that is formed by the light emitting diode 21, the drive current 3 comprising a first current 1 and a second current 2; The first current 1 is formed by a voltage difference across a resistor 7; the voltage difference formed by drive current's nodal voltage 19 and the high speed buffer output 9; a high-speed buffer output 9 formed by a comparison signal 6; a comparison signal formed by comparing the monitor signal 4 and a level control signal 30; and the second current provided by a current source whose input terminal is driven by an operational amplifier, the operational amplifier having an input signal that is the voltage difference formed by drive current's nodal voltage 19 and the high speed buffer output 9.

In further summary, it has been described that the light emitting diode driver 100 depicted in FIG. 1 supplies a drive current 3 that forms a "current source" in a flow direction 17 from the light emitting diode driver 100 to the light emitting diode 21.

In further summary, it has been described the light emitting diode driver 100A depicted in FIG. 1A supplies a drive current 3 that forms a "current sink" in a flow direction 18 from the light emitting diode 21 to the light emitting diode driver 100 A.

In further summary, there has been described an image forming device 200 that is depicted in FIG. 2 and that comprises a light emitting diode driver. The light emitting diode driver, in turn, corresponds to reference number 100 in FIG. 1 and to reference number 100A in FIG. 1A and is arranged to supply a drive current 3 to a light emitting diode 21, the light emitting diode 21 arranged with a photo detector 23 that forms a monitor signal 4 based on a radiant output 22 that is formed by the light emitting diode 21, the drive current 3 comprising a first current 1 and a second current 2 and formed by comparing the monitor signal 4 and a level control signal 30 to form a comparison signal 6; providing a buffered output signal 9 based on the comparison signal 6; providing a first current 1 is formed by a voltage difference across a resistor 7; the voltage difference formed by drive current's nodal voltage 19 and the buffer output signal 9; a buffer output signal 9 formed by a comparison signal 6; a comparison signal formed by comparing the monitor signal 4 and a level control signal 30; and the second current provided by a current source whose input terminal is driven by an operational amplifier, the operational amplifier having an input signal that is the voltage difference formed by drive current's nodal voltage 19 and the high speed buffer output 9.

In further summary, here has been described an image forming device 200 that is depicted in FIG. 2 and that comprises a light emitting diode driver. The light emitting diode driver, in turn, corresponds to reference number 100 in FIG. 1 and to reference number 100A in FIG. 1A and is arranged to supply a drive current 3 to a light emitting diode 21, the light emitting diode 21 arranged with a photo detector 23 that forms a monitor signal 4 based on a radiant output 22 that is formed by the light emitting diode 21, the drive current 3 comprising a first current 1 and a second current 2; the first current 1 is formed by a voltage difference across a resistor 7; the voltage difference formed by drive current's nodal voltage 19 and the high speed buffer output 9; a high-speed buffer output 9 formed by a comparison signal 6; a comparison signal formed by comparing the monitor signal 4 and a level control signal 30; and the second current provided by a current source whose input terminal is driven by an operational amplifier, the operational amplifier having an input signal that is the voltage difference formed by drive current's nodal voltage 19 and the high speed buffer output 9.

In further summary, it has been described that, in one embodiment, the image forming device 200 as depicted in FIG. 2 comprises any of a printing machine, a photocopying machine and a facsimile machine.

Referring again to FIGS. 1 and 1A, the light emitting diode driver corresponding to reference number 100 as depicted in FIG. 1 and to reference number 100A as depicted in FIG. 1A enables both accurate and high speed current control by means of an additional high speed signal path. This light emitting diode driver (100 and 100A) is intended for voltage-controlled current driving output circuits.

This light emitting diode driver (100 and 100A) enables current level control signals to immediately affect the controlled current's level before the traditional feedback control circuitry can respond. Compared to traditional feedback control circuits for current level control, this light emitting diode driver (100 and 100A) has dual path control, one high-speed and the other the traditional path with a dominant pole. The two paths are designed to operate together to first deliver immediate current correction by means of the high speed path, and then slowing transfer complete level control back to the slow path.

As depicted in FIGS. 1 and 1A, a high-speed buffer 8 is connected to the output of the current source 10. The operational amplifier 12 has dual responsibilities, namely, first, to adjust accurately the level of the current in the current source 10 and, second, to possess the dominant pole of the driver (100 and 100A). As a result, an increase in the level control signal 30 causes an increase in the comparator 5's comparison output signal 6 which is immediately passed to the output drive current 3 by the high-speed buffer 8, thus increasing the light emitting diode 21's radiant output 22, thereby increasing the feedback monitor signal 4 until it equals the level control signal 30. This happens very quickly and the rate at which it happens is determined by the comparator 5 and is completed before the operational amplifier 12 can respond. Thus, the large input capacitance of the driving transistor of the current source 10 does not affect the light emitting diode driver (100 and 100A)'s response to the level control signal 30. For the high-speed buffer 8 to provide current to the output drive current 3, there must be a voltage difference across the resistor 7, thus there is a difference voltage 16 present between the two input terminals 13 and 14 of the operational amplifier 12. The operational amplifier 12 slowly applies signal to the input terminal 11 of the current source 10, replacing the high-speed buffer 8's signal until the buffer 8 provides no current. Thus, both high speed and accuracy are achieved.

While various embodiments of a light emitting diode driver and image forming device including the same, in accordance with the present invention, have been described hereinabove, the scope of the invention is defined by the following claims.

What is claimed is:

1. A light emitting diode driver arranged to supply a drive current to a light emitting diode, the light emitting diode arranged with a photo detector that forms a monitor signal based on a radiant output that is formed by the light emitting diode, the drive current comprising a first current and a second current and formed by comparing the monitor signal and a level control signal to form a comparison signal; providing a buffered output signal based on the comparison signal; providing a voltage difference based on the buffered output signal and the drive current's nodal voltage; forming the first current based on the voltage difference and a resistor; providing an amplified signal based on the voltage difference; and providing the second current based on the amplified signal.

2. The light emitting diode driver of claim 1, the voltage difference based on the buffered output signal and the drive current's nodal voltage.

3. The light emitting diode driver of claim 2, the buffered output signal provided by an included high-speed buffer.

4. The light emitting diode driver of claim 3, the amplified signal provided by an included operational amplifier.

5. The light emitting diode driver of claim 4, the second current provided by an included current source.

6. The light emitting diode driver of claim 5, the operational amplifier including a first amplifier input coupled to the buffered output signal and a first terminal of the resistor and a second amplifier input coupled to the current source and a second terminal of the resistor.

7. The light emitting diode driver of claim 6, the drive current forming a current source in a flow direction from the light emitting diode driver to the light emitting diode.

8. The light emitting diode driver of claim 7 comprising a custom integrated circuit.

9. The light emitting diode driver of claim 6, the drive current forming a current sink in a flow direction from the light emitting diode to the light emitting diode driver.

10. The light emitting diode driver of claim 9 comprising a custom integrated circuit.

11. A light emitting diode driver arranged to supply a drive current to a light emitting diode, the light emitting diode arranged with a photo detector that forms a monitor signal based on a radiant output that is formed by the light emitting diode, the drive current comprising a first current and a second current; the first current formed by a voltage difference across a resistor; the voltage difference formed by drive current's nodal voltage and a high speed, buffer output; the high-speed buffer output formed by a comparison signal; the comparison signal formed by comparing the monitor signal and a level control signal; and the second current provided by a current source whose input terminal is driven by an operational amplifier, the operational amplifier having an input signal that is the voltage difference formed by drive current's nodal voltage and the high speed buffer output.

12. The light emitting diode driver of claim 11, the operational amplifier including a first amplifier input coupled to the buffered output signal and a first terminal of the resistor and a second amplifier input coupled to the current source and a second terminal of the resistor.

13. The light emitting diode driver of claim 12, the drive current forming a current source in a flow direction from the light emitting diode driver to the light emitting diode.

14. The light emitting diode driver of claim 13 comprising a custom integrated circuit.

15. The light emitting diode driver of claim 12, the drive current forming a current sink in a flow direction from the light emitting diode to the light emitting diode driver.

16. The light emitting diode driver of claim 15 comprising a custom integrated circuit.

17. An image forming device comprising a light emitting diode driver, the light emitting diode driver arranged to supply a drive current to a light emitting diode, the light emitting diode arranged with a photo detector that forms a monitor signal based on a radiant output that is formed by the light emitting diode, the drive current comprising a first current and a second current and formed by comparing the monitor signal and a level control signal to form a comparison signal; providing a buffered output signal based on the comparison signal; forming a voltage difference based on the buffered output signal and the drive current nodal voltage; providing the first current based on the voltage difference and a resistor; providing an amplified signal based on the difference voltage; and providing the second current based on the amplified signal.

18. The image forming device of claim 17, the difference voltage formed by the buffered output signal and the drive current nodal voltage.

19. The image forming device of claim 18, the buffered output signal provided by an included high-speed buffer.

20. The image forming device of claim 19, the amplified signal provided by an included operational amplifier.

21. The image forming device of claim 20, the second current provided by an included current source.

22. The image forming device of claim 21, the operational amplifier including a first amplifier input coupled to the buffered output signal and a first terminal of the resistor and a second amplifier input coupled to the current source and a second terminal of the resistor.

23. The image forming device of claim 22, the drive current forming a current source in a flow direction from the light emitting diode driver to the light emitting diode.

24. The image forming device of claim 22, the drive current forming a current sink in a flow direction from the light emitting diode to the light emitting diode driver.

25. The image forming device of claim 22 comprising a printing machine.

26. The image forming device of claim 22 comprising a photocopying machine.

27. The image forming device of claim 22 comprising a facsimile machine.

28. An image forming device comprising a light emitting diode driver, the light emitting diode driver arranged to supply a drive current to a light emitting diode, the light emitting diode arranged with a photo detector that forms a monitor signal based on a radiant output that is formed by the light emitting diode, the drive current comprising a first current and a second current; the first current formed by a voltage difference across a resistor; the voltage difference formed by drive current's nodal voltage and a high speed buffer, output; the high-speed buffer output formed by a comparison signal; the comparison signal formed by comparing the monitor signal and a level control signal; and the second current provided by a current source whose input terminal is driven by an operational amplifier, the operational amplifier having an input signal that is the voltage difference formed by drive current's nodal voltage and the high speed buffer output.

29. The image forming device of claim 28, the operational amplifier including a first amplifier input coupled to the buffered output signal and a first terminal of the resistor and a second amplifier input coupled to the current source and a second terminal of the resistor.

30. The image forming device of claim 29, the drive current forming a current source in a flow direction from the light emitting diode driver to the light emitting diode.

31. The image forming device of claim 29, the drive current forming a current sink in a flow direction from the light emitting diode to the light emitting diode driver.

32. The image forming device of claim 29 comprising a printing machine.

33. The image forming device of claim 29 comprising a photocopying machine.

34. The image forming device of claim 29 comprising a facsimile machine.

* * * * *